US009591890B2

(12) United States Patent
Too-a-Foo

(10) Patent No.: US 9,591,890 B2
(45) Date of Patent: Mar. 14, 2017

(54) SECURING DEVICE AND METHOD FOR PREVENTING REMOVAL OF A SHOE

(71) Applicant: Carmen Too-a-Foo, Dacula, GA (US)

(72) Inventor: Carmen Too-a-Foo, Dacula, GA (US)

(73) Assignee: GRAVITY SPORTS GEAR, INC., Dacula, GA (US)

( * ) Notice: Subject to any disclaimer, the term of this patent is extended or adjusted under 35 U.S.C. 154(b) by 0 days.

(21) Appl. No.: 14/800,912

(22) Filed: Jul. 16, 2015

(65) Prior Publication Data

US 2017/0013916 A1 Jan. 19, 2017

(51) Int. Cl.

| | |
|---|---|
| ***A43C 7/00*** | (2006.01) |
| ***A43C 19/00*** | (2006.01) |
| ***A43B 11/00*** | (2006.01) |

(52) U.S. Cl.

CPC ..... *A43C 7/00* (2013.01); *A43B 11/00* (2013.01); *A43C 19/00* (2013.01)

(58) Field of Classification Search

CPC .. A43B 3/18; A43B 5/18; A43B 5/185; A43B 11/00; A43B 23/28; A41D 17/00; A43C 7/00; A43C 7/005; A43C 7/02; A43C 7/04; A43C 7/06

USPC ..... 36/1.5, 2 R, 89, 132, 136, 138, 7.1 R, 36/58.5, 71.5

See application file for complete search history.

(56) References Cited

U.S. PATENT DOCUMENTS 1,464,365 A * 8/1923 Koetter ..... A43B 5/18 36/130
1,668,480 A 5/1928 Ballou et al.
1,877,080 A * 9/1932 Teshima ..... A43B 5/18 36/116
2,155,979 A * 4/1939 Prondecki ..... A43B 5/18 36/127
2,246,562 A * 6/1941 Whitley ..... A43B 5/18 36/130
3,001,500 A 9/1961 Pinnes et al.
3,001,501 A 9/1961 Rede et al.
3,408,754 A * 11/1968 Kueter ..... A43B 5/0415 36/117.1
4,649,939 A 3/1987 Curtis
4,713,895 A * 12/1987 Vallieres ..... A43B 3/24 36/1.5
4,854,056 A 8/1989 Levin
4,976,050 A 12/1990 Houghteling
(Continued)

OTHER PUBLICATIONS

A60 Ankle Support, djoglobal.com, Feb. 21, 2015.
(Continued)

*Primary Examiner* — Khoa Huynh
*Assistant Examiner* — Megan Brandon
(74) *Attorney, Agent, or Firm* — The Concept Law Group, P.A.; Scott D. Smiley; Erin A. Martin

(57) ABSTRACT

A securing device for preventing removal of a shoe comprising a web selectively attachable to an outer surface of a shoe and configured to at least partially cover the shoe. The web includes a bottom portion having a center section securable to a front region of the shoe and a leg support section securable to a user's leg. The web further includes a top portion removably couplable to the bottom portion. The top portion includes a coupled position at least partially covering a lace of the shoe and an uncoupled position leaving the lace of the shoe exposed to an ambient environment.

16 Claims, 10 Drawing Sheets

(56) References Cited

U.S. PATENT DOCUMENTS

| | | | | |
|---|---|---|---|---|
| 5,109,614 | A | 5/1992 | Curry | |
| 5,307,569 | A * | 5/1994 | Melcher | A43D 999/00 36/50.1 |
| 5,430,960 | A | 7/1995 | Richardson | |
| 5,566,477 | A * | 10/1996 | Mathis | A43B 3/0078 36/100 |
| 5,692,319 | A * | 12/1997 | Parker | A43B 7/1495 36/114 |
| 5,694,703 | A * | 12/1997 | Diaz | A43B 3/163 36/7.1 R |
| 5,704,140 | A * | 1/1998 | Fields | A43B 7/20 36/132 |
| 5,822,887 | A | 10/1998 | Turner | |
| 5,848,484 | A | 12/1998 | Dupree et al. | |
| 5,855,078 | A * | 1/1999 | Starker | A43C 13/14 36/131 |
| 6,126,627 | A | 10/2000 | Brennan | |
| 6,161,314 | A | 12/2000 | Kamrin | |
| 6,272,772 | B1 | 8/2001 | Sherman | |
| 6,601,323 | B2 | 8/2003 | Tsujino et al. | |
| 6,775,929 | B2 | 8/2004 | Katz et al. | |
| 7,013,586 | B1 | 3/2006 | Hatfield et al. | |
| 7,222,440 | B2 * | 5/2007 | Dombowsky | A43B 3/16 36/11.5 |
| 7,243,444 | B2 | 7/2007 | Selner | |
| 7,334,354 | B2 | 2/2008 | Foxen et al. | |
| 7,444,768 | B2 * | 11/2008 | Friton | A43B 23/26 36/50.1 |
| 8,407,917 | B2 * | 4/2013 | Barrick | A43B 3/00 36/113 |
| 8,689,469 | B2 | 4/2014 | Foxen et al. | |
| 8,747,340 | B2 | 6/2014 | Gerber et al. | |
| 2003/0159312 | A1 * | 8/2003 | Farys | A43B 1/0072 36/51 |
| 2005/0076538 | A1 * | 4/2005 | Sapp | A43B 5/18 36/72 R |
| 2005/0257404 | A1 * | 11/2005 | Daza | A43B 7/32 36/72 R |
| 2008/0010866 | A1 | 1/2008 | Mallamohamad | |
| 2012/0246972 | A1 | 10/2012 | Newkirk | |
| 2013/0227765 | A1 | 9/2013 | Bailey et al. | |
| 2013/0333242 | A1 | 12/2013 | Whiting | |
| 2014/0259763 | A1 | 9/2014 | Rady | |
| 2014/0259773 | A1 | 9/2014 | Johnson | |
| 2015/0089839 | A1 * | 4/2015 | James | A43B 11/00 36/102 |

OTHER PUBLICATIONS

Air Jordan 6 "Carnivore" Custom, nicekicks.com, 02013-04-16.
Air Jordan XX8, nicekicks.com, Jun. 9, 2015.
Air Jordan XX8 Upcoming Colorways Another Look, nicekicks.com, Feb. 18, 2013.
Aircast AirLift PTTD Brace Foot & Ankle Orthosis, e-medicalbroker.com, Feb. 21, 2015.
Aircast AirLift PTTD Brace, betterbraces.com, Feb. 21, 2015.
Airlift PTTD Brace, djoglobal.com, Feb. 21, 2015.
AirSport, djoglobal.com, Feb. 21, 2015.
AMOS Universal Ice & Snow Mud Wet Grass Climbing Hiking Unisex Anti Slip Spikes Cleats Grippers Shoe Grip Cover Boot Crampons Ince Snow Traction Aid, amazon.co.uk, May 4, 2015.
Arkema unveils its Latest Polymer Innovations at Brasilplast 2009, omnexus.specialchem.com, May 5, 2009.
Attractive Lace-up Wedge Heel, stylishplus.com, Feb. 21, 2015.
Snow boots with ice Slip Staples GB s Sizes 36-43, ebay.es, Jul. 22, 2015.
Hickies Elastic No Tie Shoelaces, amazon.com, Jul. 4, 2015.
Due North Oversized Ice Traction Cleats, thewarmingstore.com, 2015.
Chris's Home Hot Sell Elastic Magic Spike Shoe Cover Anti Slip Ice Gripper with Crampon Walk on Ice Snow Ghat for Mountaineering Climbming, amazon.com, May 4, 2015.
Mueller Soccer Ankle Support, physioroom.com, Feb. 21, 2015.
No-Slip Ice Cleats Extreme, hotheadz.net, May 4, 2015.
Sure Grip Goil Cleats-Boot/Shoe Size 12 Plus, htent.com/catalog/item.php, May 4, 2015.
Ice crampon 026, hoyaoutdoor.com, Aug. 29, 2015.
Dual Traction Snow Grabbers JH-209, blacktoe.co.uk, May 4, 2015.
Ice cleats, Pocket ice cleats, Quick-Use Ice Cleats, Standard Ice Cleats, Extreme Ice Cleats, Pro Ice Cleats, move. kinetic-fishing.com, May 4, 2015.
Korkers Ultra Ice Cleats—one size fits all, gearcor.com, May 4, 2015.
Mammut Nordwand TL, alpineteam.co/nz, Oct. 7, 2013.
Soccer ankle brace, muellersportsmed.com, Feb. 21, 2015.
Nike Sock Dart "Be True" Release Date, Jun. 26, 2015, nicekicks.com.
Nike Zvezdochka 10th Anniversary, sneakernews.com, Dec. 23, 2014.
Nike Zvezdocha by Mac Newson—2014, visioninvisible.com.ar, 2014.
OC System Spares, olang.co.uk, May 4, 2015.
Ronnie Fieg X Puma Disc Blaze OG "Cove" Release Date, nicekicks.com, Nov. 19, 2012.
MagicSpiker, magicspikeeurope.com, May 4, 2015.
Small Snow Shoe Ice Grip Crampon Spike Size 2-½—6uk Anti Slip Cleats Studs, tooltime.co.uk.
Magic Spike Crampon, sorbus-intl.co.uk, May 4, 2015.
Spare Spike Consumer Grade Ice & Snow Traction Device for Shoes and Boots, slipresistant.net, May 4, 2015.
Spare Spike, winterwalking.com, May 4, 2015.
Stabilicers Walk, 32north.com, May 4, 2015.
Marni Mania, Marni platforms from Spring Summer 2009 runway collection, stylescientist.blogspot,com, 2009.
Surf Air Strap, gumbylock.com/au, Feb. 21, 2015.
SweetSpot, Inc., band . . . slip onto players' cleats to keep their laces from coming untied in games and practice sessions., sweetspotworld.com, Aug. 29, 2015.
Build Your Own 3-Packi—Lock Laces Elastic No Tie Shoelaces, locklaces.com, Jul. 3, 2015.

* cited by examiner

SECURING DEVICE AND METHOD FOR PREVENTING REMOVAL OF A SHOE

FIELD OF THE INVENTION

The present invention relates generally to footwear accessories and, more particularly, relates to a securing device and method for securing shoes to a user's feet.

BACKGROUND OF THE INVENTION

It is well known that children often remove their shoes simply by kicking them off of their feet. Such removal is problematic for caretakers who must continuously replace the shoes on the child's feet. This is especially burdensome when the child is kicking and screaming. On occasion, shoes may become inadvertently removed or dislodged due to other reasons, such as when the child is kicking during a sporting event, e.g., a football or soccer game.

A number of known shoe accessories exist which attempt to secure shoes to children and/or adult's feet. At least one known device provides an excess tension system for the laces. Problematically, such excess tension system causes discomfort, chafing, and blisters due to the tightness of the shoes around the feet.

Other known devices, which aim to secure a child's foot within his or her shoes, utilize an ankle strap that secures around and completely covers the child's ankle. Such ankle strap is often made of a material such as leather, which results in discomfort, chafing, and blisters. In addition, the ankle strap may be difficult to remove, leading to frustration for the caretaker and the child. Moreover, the ankle straps often leave the child's laces exposed making it easy for the child to untie their shoes, even when they are not supposed to. Known devices that do completely cover the child's laces, often cover the entire upper surface of the shoe which results in heat accumulation within the shoe. The child's feet become overheated and accumulate sweat, causing athlete's foot, toenail fungus, and the like.

Another example of a shoe accessory which aims to prevent a foot from slipping out of a shoe, is an insert made of a predetermined shape. Such insert may only be used with shoes of specific shapes, thereby limiting the ability of the wearer to utilize the shoe accessory with various types of shoes. Additional shoe accessories which aim to secure the feet within the shoe, are not customizable in color and are aesthetically unappealing.

Therefore, a need exists to overcome the problems with the prior art as discussed above.

SUMMARY OF THE INVENTION

The invention provides a securing device and method for preventing removal of a shoe that overcomes the hereinafore-mentioned disadvantages of the heretofore-known devices and methods of this general type and that selectively attaches to an outer surface of a shoe to prevent removal of the shoe.

With the foregoing and other objects in view, there is provided, in accordance with the invention, a securing device for preventing removal of a shoe. The securing device includes a web selectively attachable to an outer surface of the shoe and configured to at least partially cover the shoe. The web includes a bottom portion having a center section securable to a front region of the shoe and a leg support section securable to a user's leg. The web further includes a top portion removably couplable to the bottom portion and having a coupled position at least partially covering a knot of a shoe lace and an uncoupled position leaving the shoe lace exposed to an ambient environment.

In accordance with another feature, the web defines a plurality of apertures sized and shaped to expose a substantial portion of the shoe to the ambient environment.

In accordance with a further feature of the present invention, the center section further comprises a securing strap substantially encircling a bottom portion of the shoe.

In accordance with a further feature, the top portion defines at least one aperture sized and shaped to receive at least one fastener disposed on the bottom portion.

In accordance with another feature, the bottom portion further comprises a male tension adjusting member adapted to removably and fixedly couple with a female tension adjusting member disposed on the top portion.

In accordance with yet another feature, the bottom portion is of a color different than a color of the top portion.

In accordance with a further feature of the present invention, the leg support section further comprises an inner surface having a padding extending substantially a length of the inner surface.

In accordance with an additional feature, the web further comprises a heel strap extending from a heel portion of the shoe substantially to the front region of the shoe.

In accordance with yet another feature, the leg support section secures to the user's leg above an ankle of the user.

In accordance with the present invention, another variation of a securing device for preventing removal of a shoe is disclosed that includes a web selectively attachable to an outer surface of a shoe and configured to at least partially cover the shoe. The web includes a bottom portion having a center section securable to a front region of the shoe and a leg support section securable to a user's leg. The web also includes a top portion coupled to the bottom portion. A securing strap may be coupled to at least one of the bottom portion and the top portion. The securing strap is operable to decouple the web from the outer surface of the shoe.

In accordance with a further feature of the present invention, the web further comprises a waterproof material.

In accordance with another feature, an embodiment of the present invention also includes the securing strap extending along a bottom surface of the shoe to substantially encircle the shoe.

In accordance with a further feature of the present invention, the bottom portion further comprises a first fastener adapted to couple to a second fastener disposed on the top portion.

In accordance with a further feature of the present invention, the web further comprises a plurality of tension adjusting members disposed on the bottom portion adapted to couple with a second plurality of tension adjusting members disposed on the top portion.

In accordance with a further feature of the present invention, the leg support section secures to the user's leg above an ankle of the user.

In accordance with yet a further feature of the present invention, the web defines a plurality of apertures size and shaped to expose a substantial portion of the shoe to the ambient environment.

In accordance with the present invention, a method of preventing removal of a shoe is disclosed, the method including providing a securing device for preventing removal of a shoe. The securing device includes a web selectively attachable to an outer surface of a shoe and configured to at least partially cover the shoe. The web includes a bottom portion having a center section securable to a front region of the shoe and a leg support section securable to a user's leg and a top portion removably couplable to the bottom portion. The web further includes a coupled position at least partially covering a knot of a lace of the shoe and an uncoupled position leaving the lace of the shoe exposed to an ambient environment. The method also includes securing the center section to the front region of the shoe, coupling the leg support section to the user's leg, and coupling the top portion to the bottom portion.

In accordance with a further feature of the present invention, the method includes coupling the leg support section to the user's leg above an ankle of the user.

In accordance with a further feature of the present invention, the method includes adjusting a tension of the web using at least one tension adjusting member.

In accordance with yet a further feature of the present invention, the method includes removing the web from the outer surface of the shoe by uncoupling the top portion from the bottom portion.

Although the invention is illustrated and described herein as embodied in a securing device and method for preventing removal of a shoe, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of a shoe, or from a front end of the toe cap to the heel.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
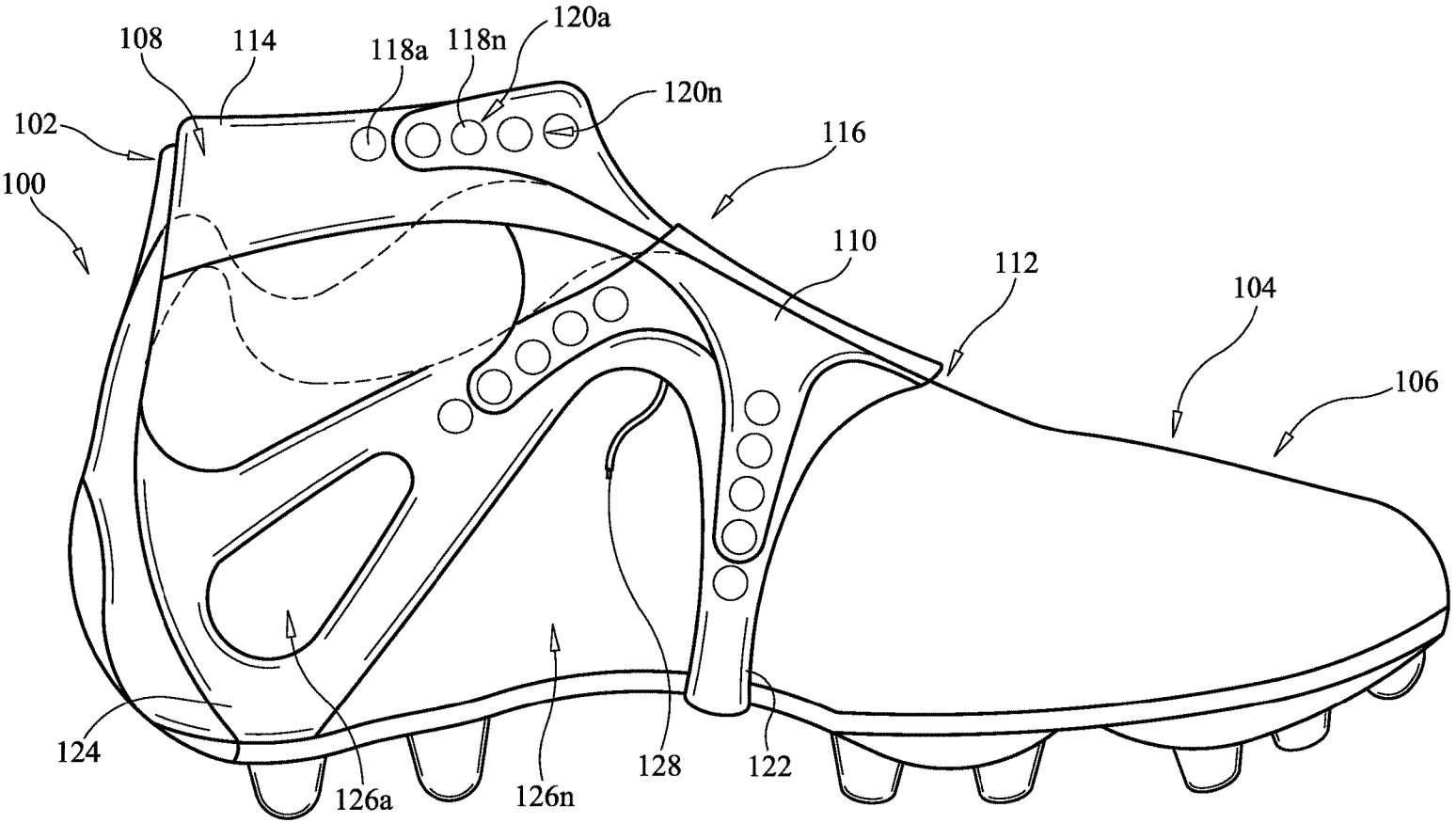
FIG. 1 is an elevational side view of a securing device for preventing removal of a shoe from a user's foot in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient securing device and method for preventing removal of shoes from a user's feet. Embodiments of the invention provide the shoe securing device including a web that is selectively attachable to an outer surface of a shoe and configured to at least partially cover the shoe. The web provides a user the ability to easily and conveniently attach and remove the securing device from the shoe through the use of two portions that removably coupled to each other through one or more fasteners. Embodiments of the invention also provide the user with a comfortable securing device that does not restrain the user's ankle and which leaves a substantial portion of the shoe exposed to the ambient environment, preventing heat accumulation within the shoe.

Referring now to FIG. 1, one embodiment of the present invention is shown in an elevational side view. FIG. 1 shows several advantageous features of the present invention, but, as will be described below, the invention can be provided in several shapes, sizes, combinations of features and components, and varying numbers and functions of the components. The first example of a securing device 100 for preventing removal of a shoe, as shown in FIG. 1, includes a web 102 selectively attachable to an outer surface 104 of a shoe 106. The web 102 is configured to at least partially cover the shoe 106. The term "shoe" is used in the broadest possible sense and refers to any durable covering of the foot including, but not limited to conventional shoes, slippers, sandals, flip-flops, high heels, and boots constructed of any material. Advantageously, the web 102 defines one or more apertures 126*a-n* sized and shaped to expose a substantial portion of the shoe 106 to an ambient environment. The indicator "a-n" is intended to represent any number of apertures 126, where the number of apertures 126 between "a" through "n" can be any number. The exposure to the ambient environment prevents heat from accumulating within the shoe 106. The size and shape of the apertures 126*a-n* may vary, as the shoe securing device 100 may be provided having interchangeable portions and straps, as discussed in further detail below.

FIG. 1 depicts the web 102 having a bottom portion 108 including a center section 110 securable to a front region 112 of the shoe 106. In one embodiment, the front region 112 of the shoe 106 is the portion of the shoe 106 surrounding a user's mid-foot. In another embodiment, the front region 112 may extend from the portion of the shoe 106 surrounding a user's mid-foot to the toe cap of the shoe 106. In other embodiments, the front region 112 may extend from the portion of the shoe 106 surrounding a user's mid-foot to the flex point of the shoe 106.

The bottom portion 108 further includes a leg support section 114 securable to a user's leg. In a preferred embodiment, the user's leg includes the portion of the leg above the user's ankle, so as to prevent the leg support section 114 from rubbing against the user's ankle in an uncomfortable manner. In another embodiment, the leg support section 114 is securable to the user's ankle. In other embodiments, the leg support section 114 may be securable to the user's leg below the user's ankle, though the above ankle configuration is preferred.

In one embodiment, the web 102 further includes a top portion 116 coupled to the bottom portion 108. In one embodiment, the top portion 116 is fixedly coupled to the bottom portion 108 to form a single unit. In other embodiments, the top portion is removably couplable to the bottom portion 108. In one embodiment, in order to couple the bottom portion 108 to the top portion 116, the bottom portion 108 may include one or more fasteners 118*a-n* sized and shaped to mate with one or more fasteners 120*a-n* disposed on the top portion 116.

In one embodiment, the fastener 118 is a male portion adapted to removably and fixedly couple the fastener 120 that is a female portion, which together form a snap fastener. In another embodiment, the fastener 120 may be the male portion, with the fastener 118 being the female portion. In a further embodiment, the fastener 118 may be an aperture sized and shaped to receive the fastener 120 through the aperture. Conversely, the fastener 120 may be an aperture sized and shaped to receive the fastener 118 through the aperture. In other embodiments, the fasteners 118, 120 may be a hook-and-loop configuration, a tongue-and-groove-configuration, or other fastening mechanisms that allow the user to adjust the tension of the securing device 100. The fasteners 118, 120, i.e., tension adjusting members, provide the user with the ability to adjust the tension of the securing device 100 to the user's shoe 106. Advantageously, the level of tension may be adjusted from several angles to ensure a secure fit over shoes of various sizes and shapes.

As an added advantage, for an aesthetically pleasing appearance, the bottom and top portions 108, 116 may be manufactured in a variety of colors. As such, the user may select a color or colors that match the shoe 106 to blend with the color of the shoe 106 for users who desire to minimize attention to the securing device 100. The user can also mix and match the color of the bottom and top portions 108, 116. This may be especially desirable for sports teams, schools, companies, associations, and the like, who desire to customize the securing device 100 to match their associated colors. In addition, a logo, e.g., a company logo, school logo, sports team logo, etc., may be added to either or both the bottom and top portions 108, 116 for use during various events.

In one embodiment, the securing device 100 may include various functional components. For example, in one embodiment, the securing device 100 may include a wireless communication system and one or more sensors configured to, without limitation, transmit audio, receive data, provide data, and communicate with external devices, such as, without limitation, a smart phone. In one embodiment, the securing device 100 may include one or more health monitoring systems, e.g., a pedometer, a fitness tracking system, etc., and/or a Global Positioning System (GPS) chip. The securing device 100 may also include one or more storage compartments for storing items, e.g., without limitation, identification cards, money, head phones, and other miscellaneous items.

To prevent the user, e.g., a child, from removing the shoe 106, in one embodiment, the top portion 116 includes a coupled position at least partially covering a knot of a shoe lace 128. In other embodiments, the securing portion 116 may completely cover the shoe lace 128 to prevent the user from accessing the shoe lace 128. Using FIG. 2 as an example, the securing device 100 is shown in a perspective view with the securing portion 116 having a width 200 and a length 202 sufficient to completely cover the shoe laces 128. In one embodiment, the securing device 100 may include a pocket (not shown) sized and shaped to store the laces of the shoe 106 within the pocket.

Figure 2:
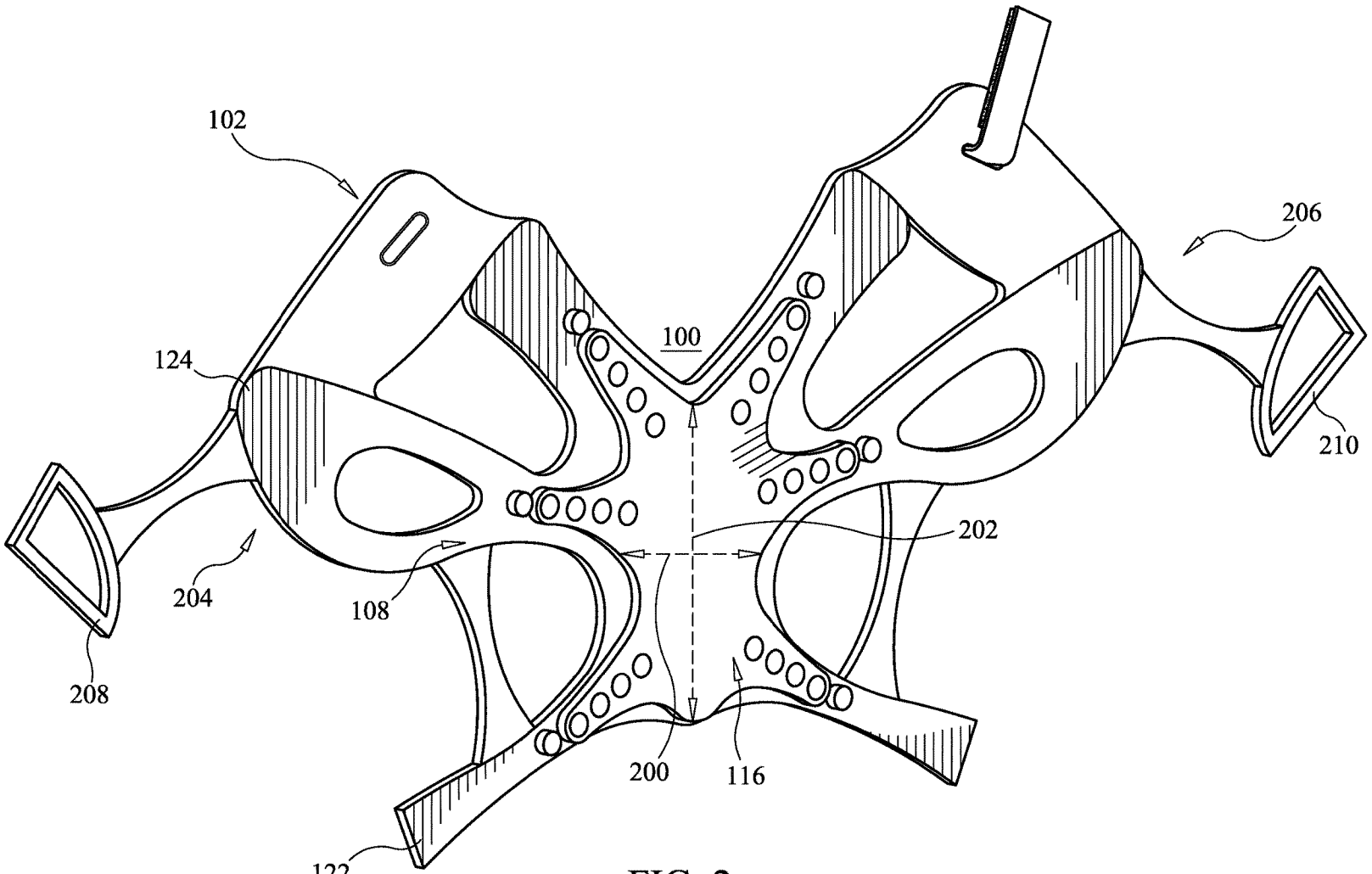
FIG. 2 is a perspective view of a web of the securing device of FIG. 1.

With reference still to FIG. 2, in one embodiment, to couple the securing device 100 to the shoe 106 (FIG. 1), the bottom portion 108 includes a right side portion 204 and a left side portion 206 that is a mirror image of the right side portion 204. In use, each side portion 204, 206 folds over the respective side of the shoe 106. Specifically, the right and left side portions 204, 206 include end members 208, 210 respectively, which fold under the shoe 106 and wrap around the cleats when present on the bottom surface 300 (FIG. 3) of the shoe 106 to secure the device 100 to the shoe 106. In one embodiment, the end members 208, 210, may together form a heel strap 124.

In one advantageous embodiment, the web 102 is made of a flexible, sturdy, elastically deformable material, such as, rubber or a PVC-based polymer that conforms to the shape of the shoe 106 and returns back to its static-state shape after its change in shape. In other embodiments, the web 102 may be composed of a waterproof material, for example and without limitation, neoprene, a composite material, a metallic material, a fabric mesh material, or another material that may or may not have deformably elastic properties (e.g., to change its shape and return back to its static-state shape after its change in shape). The material may include a gloss coating for an aesthetically pleasing appearance and may be lightweight so as not to add unnecessary weight to the user's foot during sporting activities, e.g., soccer, baseball, running, etc. Advantageously, the material may be washed and is able to withstand prolonged exposure to rain, mud, and other outside elements.

In one advantageous embodiment, in order to stabilize the web 102 in a stationary position on the shoe 106, one or more portions of the web 102 may include frictional coating (not shown). Generally speaking, the frictional coating is an anti-slip material that secures the web 102 in a stationary position on the outer surface 104 of the shoe 106 to prevent the securing device 100 from sliding. The frictional coating can be any friction-inducing material, e.g., rubber, tape or another similar frictional coating with a coefficient of friction generally high enough to prevent the securing device 100 from sliding horizontally and/or vertically on the shoe 106. In other embodiments, the material of the web 102 itself may be of a high enough coefficient of friction to prevent the securing device 100 from sliding on the shoe 106.

Figure 3:
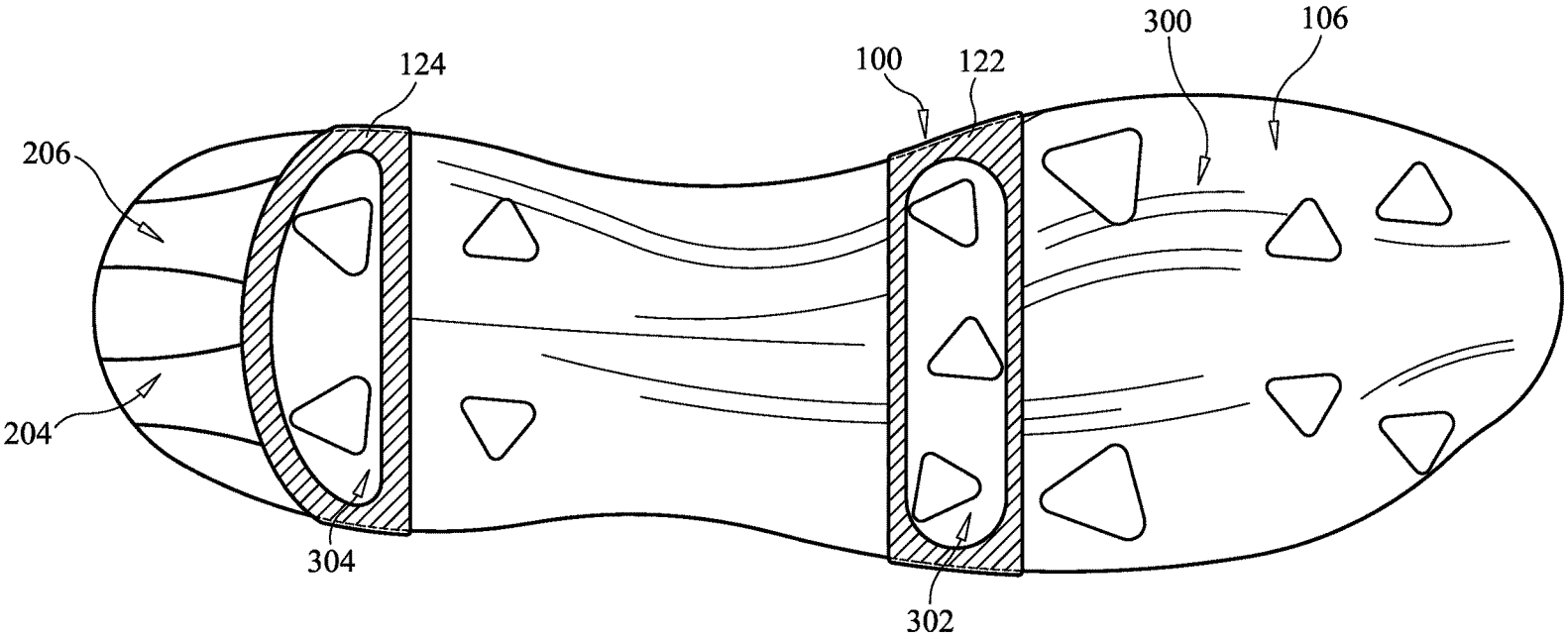
FIG. 3 is a bottom plan view of the shoe of FIG. 1 depicting a securing strap and a heel strap extending along the bottom surface of the shoe in accordance with the present invention.

With reference now to FIGS. 1 through 3, in order to further secure the securing device 100 to the shoe 106, in one embodiment, the web 102 includes a securing strap 122. In one embodiment, the securing strap 122 is coupled to at least one of the bottom portion 108 and the top portion 116. The securing strap 122 may be fixedly or removably coupled to either the bottom portion 108 or the top portion 116. The securing strap 122 may extend from the sides of the shoe 106 along the bottom surface 300 of the shoe 106 to substantially encircle the shoe 106. "Substantially encircle" is defined herein as at least mostly, but not necessarily completely, encircling the shoe 106. The securing strap 122 is shown at the mid-portion of the shoe 106 to firmly hold the securing device 100 around the user's foot.

For added stability, the web 102 may include the heel strap 124 located at the heel portion so of the shoe 106 so as to prevent the user's heel from slipping out of the shoe 106. In one embodiment, for use mainly with shoes having a flat bottom surface 300, a band (not shown) may connect the securing strap 122 to the heel strap 124 along the bottom surface 300 of the shoe 106. Advantageously, the securing strap and 122 and the heel strap 124 prevent the user's shoes from flying off of the user's foot during forceful motions, e.g., kicking, during sporting events such as soccer, kickball, and the like.

With reference now specifically to FIG. 3, the securing strap 122 and the heel strap 124 each define an aperture 302, 304 respectively. Advantageously, the apertures 302, 304 provide the user with the securing strap 122 and heel strap 124 that can fit over shoes having various bottom surface features, for example, without limitation, soccer cleats, baseball cleats, running shoes, and the like. As an added advantage, the apertures 302, 304 allow the straps 122, 124 to be flush with the bottom surface 300 of the shoe 106 so as not to disrupt or interfere with walking, running, or other movements that cause the user's foot to contact a ground or other surface. The straps 122, 124 may be made of, without limitation, the same material as the remaining portions of the web 102, or alternatively, may be an elastic band having sufficient elasticity to stretch along the bottom surface 300 of the shoe 106, while maintaining the tension of the securing device 100.

Figure 4:
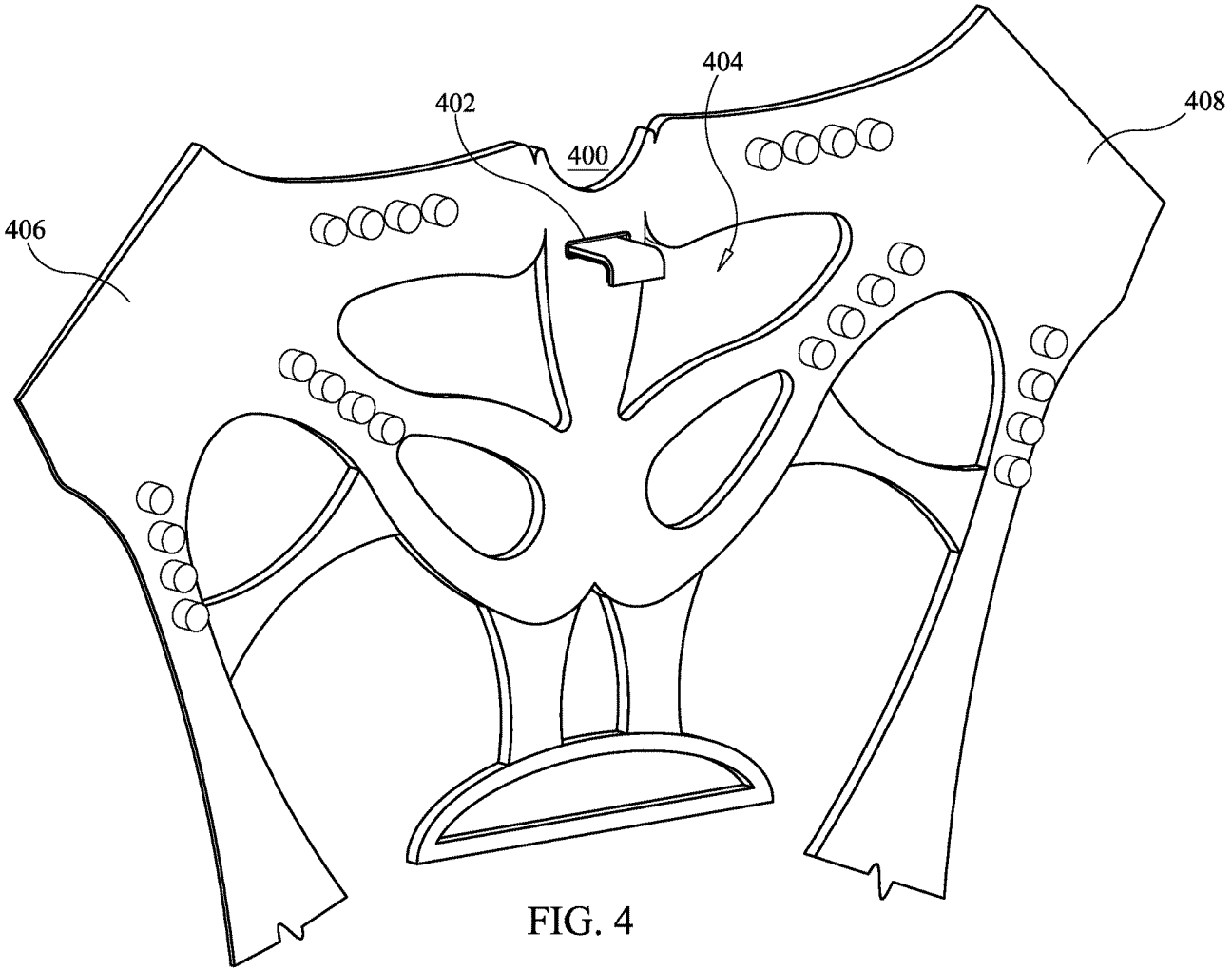
FIG. 4 is a perspective view of an adjustment strap of the securing device of FIG. 1 in accordance with another embodiment of the present invention.

With reference now to FIG. 4, an alternate embodiment of the bottom portion 400 is depicted in a perspective view. FIG. 4 depicts the bottom portion 400 having an adjustment strap 402 that provides the user with the ability to pull and adjust the tension and placement of the securing device 100 when coupled to the user's shoe 106 (FIG. 1). The adjustment strap 402 may include a wire insert for stability and assistance with tension adjustment of the securing device 100. The adjustment strap 402 may be, without limitation, a hook-and-loop attachment, a piece of neoprene fabric, a fastener having a male portion adapted to couple to a complimentary female portion, or another similar attachment mechanism that provides the user with the ability to adjust the tension of the securing device 100 (FIG. 1). FIG. 4 depicts the bottom portion 400 having a right side portion 406 and a left side portion 408 configured to overlap the respective sides of the shoe 106 to allow for further expansion and custom fit for individual users. The right and left side portions 406, 408 may be tapered or may be of a uniform thickness.

With reference to FIG. 1, in conjunction with FIG. 4, in contrast to the coupled position of FIG. 2, FIG. 4 depicts the bottom portion 400 in an uncoupled position leaving the shoe lace 128 exposed to the ambient environment. More specifically, the top portion 116 is no longer coupled to the bottom portion 400, thereby providing the user with the ability to easily and conveniently lift and remove the web 102 from outer surface 104 of the shoe 106. Said another way, the user can decouple the web 102 from the outer surface 104 of the shoe 106 when the shoe laces 128 are exposed to the ambient environment. In order to provide the exposure to the ambient environment, the bottom portion 400 defines one or more apertures 404. The securing strap 122 and/or the heel strap 124 may also be easily removed from the bottom surface 300 (FIG. 3) in conjunction with the bottom portion 400, in embodiments utilizing the securing strap 122 and/or the heel strap 124 to remove the securing device 100.

Figure 5:
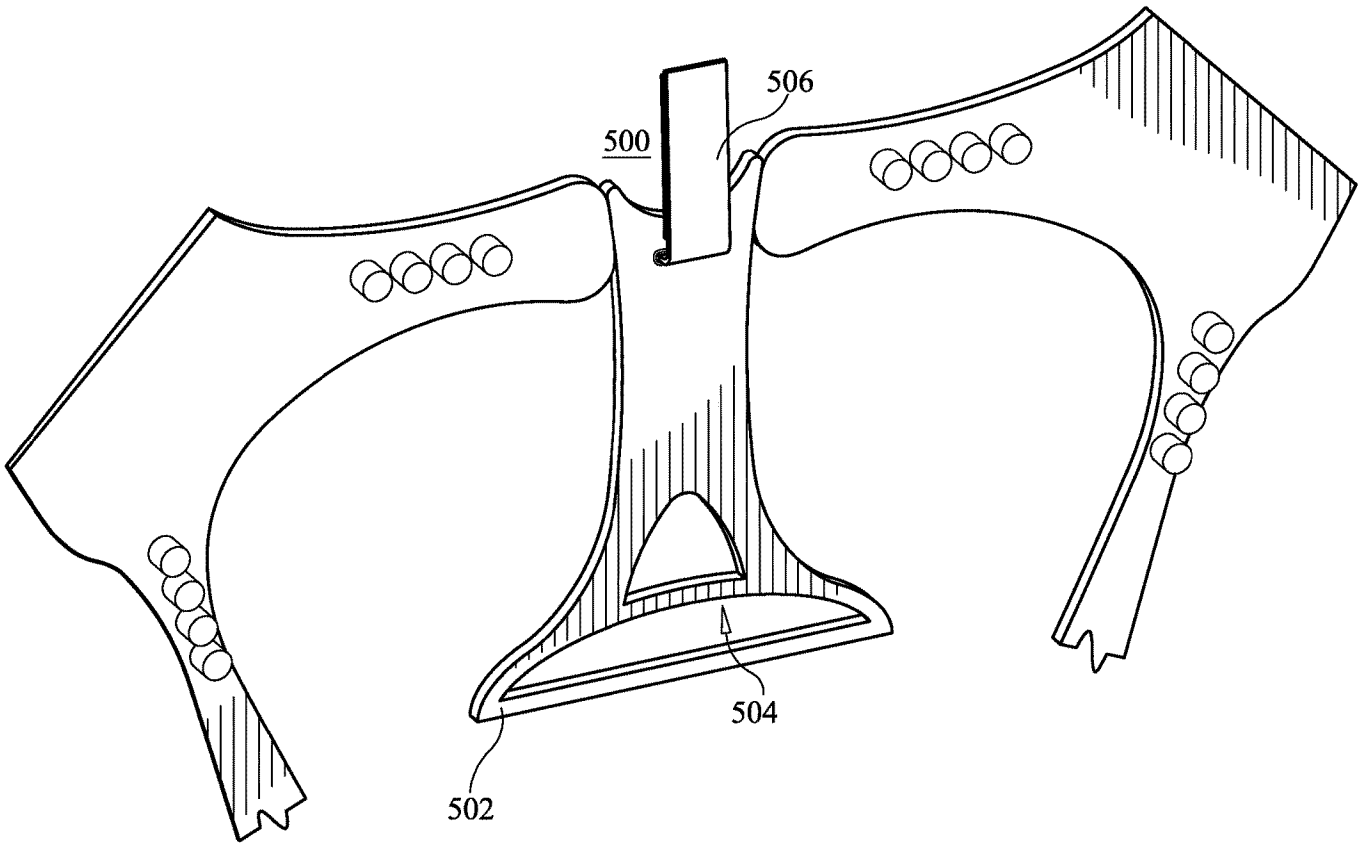
FIG. 5 is a perspective view of a hook-like member of the securing device of FIG. 1 in accordance with another embodiment of the present invention.

With reference now to FIG. 5, an alternate embodiment of the bottom portion 500 is depicted in a perspective view. FIG. 5 depicts the bottom portion 500 having a hook-like member 502 that may advantageously span a front portion of the shoe 106 (FIG. 1) and wrap around to the bottom surface 300 (FIG. 3) of the shoe 106 for added security. In one embodiment, the hook-like member 502 defines an aperture 504 that allows cleats or other bottom surface protrusions to be inserted therein so as not to disrupt the user's balance when walking, running, or otherwise stepping. In other embodiments, the hook-like member 502 may be void of the aperture 504 and may span a front portion of the shoe 106, without wrapping completely underneath the shoe 106 to the bottom surface 300. The bottom portion 500 may or may not include an adjustment strap 506 similar to the adjustment strap 402 described with respect to FIG. 4.

Figure 6:
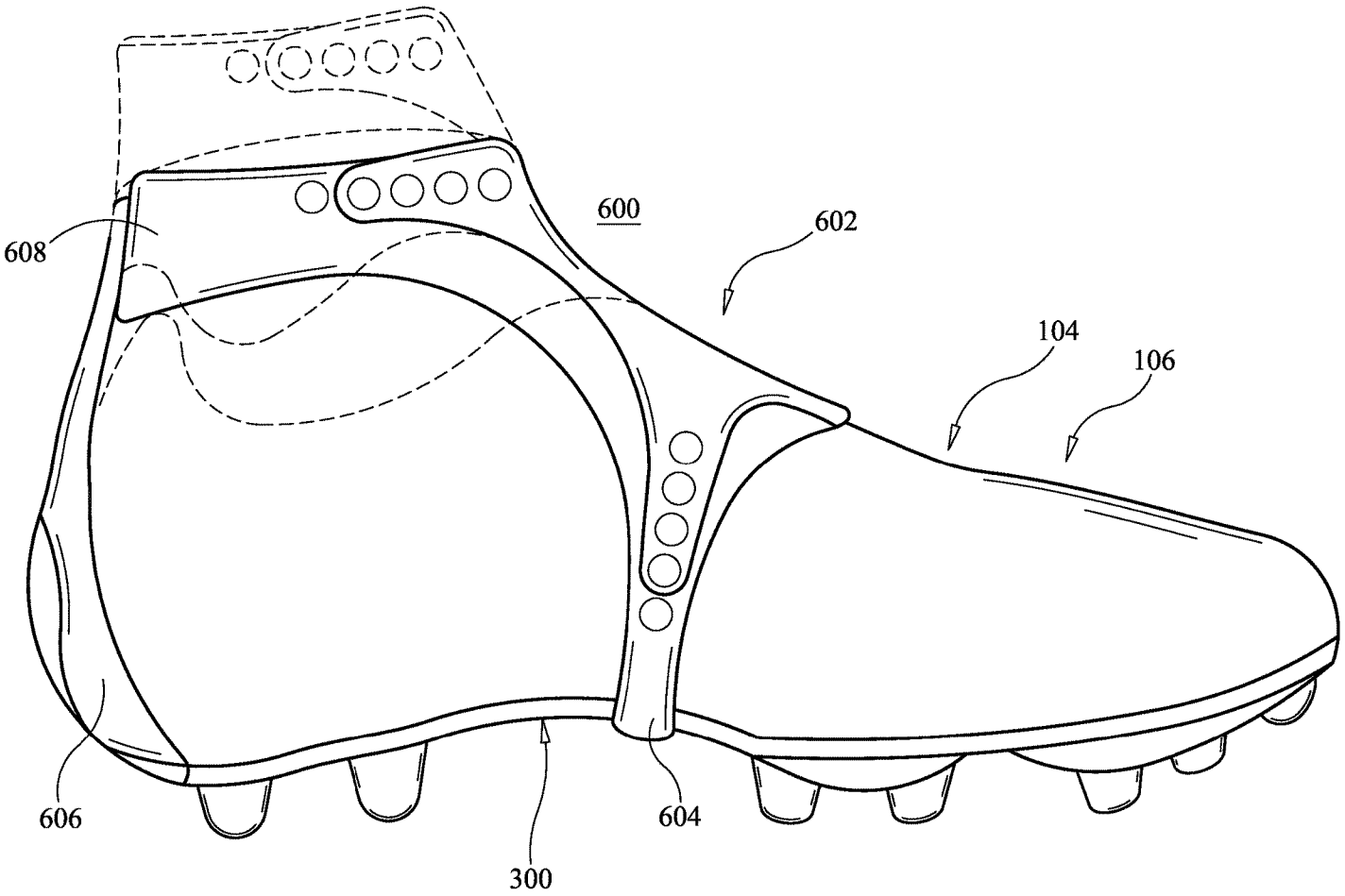
FIG. 6 is an elevational side view of the securing device for preventing removal of a shoe including the web configured to at least partially cover the shoe in accordance with another embodiment of the present invention.

With reference now to FIG. 6, another embodiment of the securing device 600 is shown in an elevational side view. In contrast to the heel strap configuration depicted in FIG. 3, for the securing device 100, the web 602 may be coupled to the shoe 106 using a securing strap 604, similar to the securing strap 122 of FIG. 1. The securing strap 604 may or may or may not substantially encircle the shoe 106. In one embodiment, the web 602 includes a rear strap 606 configured to grip the outer surface 104 of the shoe 106 at a rear portion of the shoe 106. More specifically, in one embodiment, the rear strap 606 is coupled to a leg support section 608 and extends from the leg support section 608 towards the bottom surface 300 of the shoe 106. In other embodiments, the rear strap 606 may be fixedly coupled to the leg support section 608 so as to reduce manufacturing costs as one mold may be used to create the leg support section 608 and the rear strap 606. Advantageously, the user may conveniently adjust the tension of the rear strap 606 in conjunction with the leg support section 608 when the leg support section 608 is secured to the user's leg for a secure fit. In one embodiment, the leg support section 608 may be located approximately within 1.0-2.0 inches above the ankle portion of the shoe 106, for compatibility with sneakers, high tops and the like. In other embodiments, the leg support section 608 may be a distance outside of this range.

Figure 7:
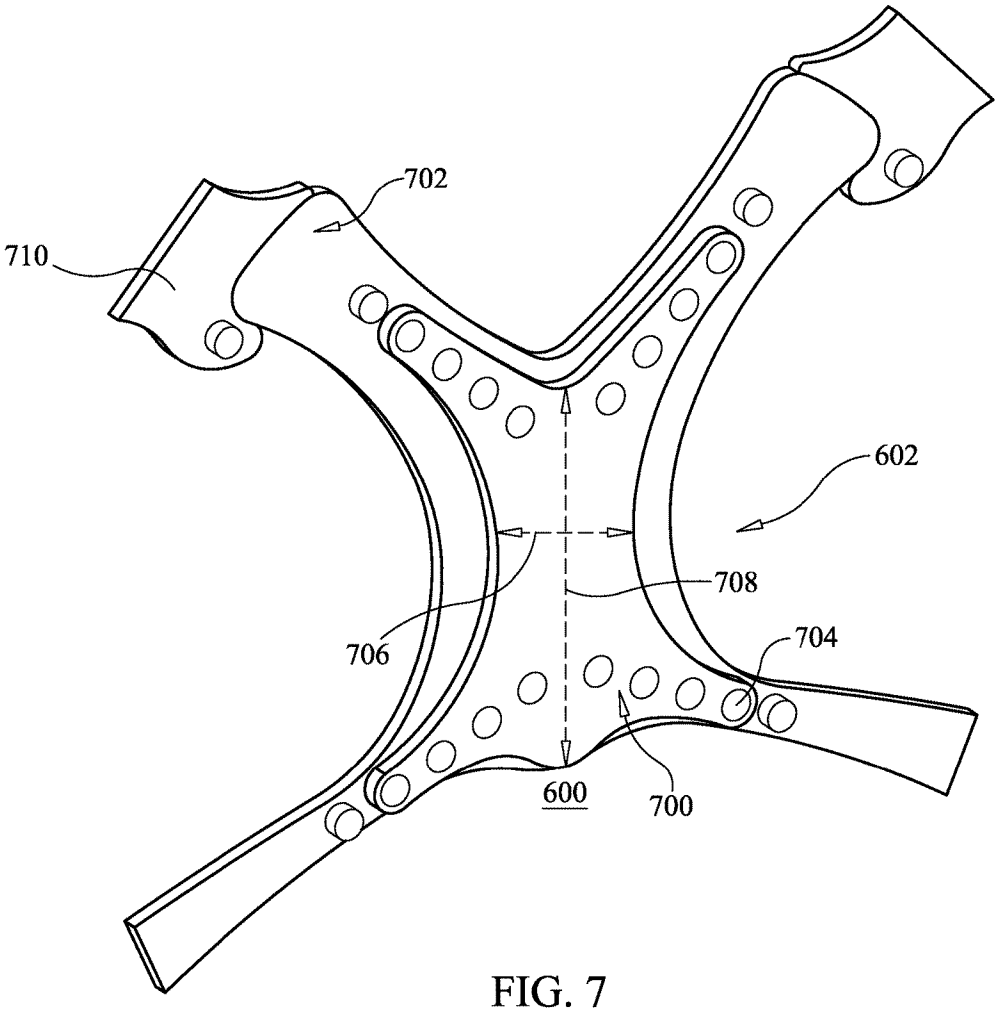
FIG. 7 is an elevational view of a web of the securing device of FIG. 6.

With reference now to FIG. 7, the web 602 is shown having the top portion 700 coupled to the bottom portion 702 through the fasteners 704. The fasteners 704 may be the same or different from the fasteners 118, 120 describe above. The bottom portion 702 may include a width 706 and a length 708 sufficient to at least partially cover the shoe laces when placed on the shoe 106 (FIG. 6), as similarly described above with respect to the securing device 100.

When coupling the securing device 600 to the shoe 106, the user may utilize one or more rear fasteners 710 to the rear portion of the shoe 106. The rear fasteners 710 may be, without limitation, a hook-and-loop fastener, a clasp, a snap fastener, or another similar fastening mechanism with minimally invasive features. In order to provide enhanced safety features, the rear fasteners 710 may include one or more safety features, e.g., flashers, a corded light system, glow in the dark components, reflectors, a GPS chip, and the like, to aid in visibility of the securing device 600 when worn by the user at night. These safety features may be especially beneficial when the user is a child playing outside at night. The safety features are not limited to placement on the rear fasteners 710; rather, the safety features may be disposed in various widths and lengths on the first and/or top portions of the securing devices 100, 600 as well.

Figure 8:
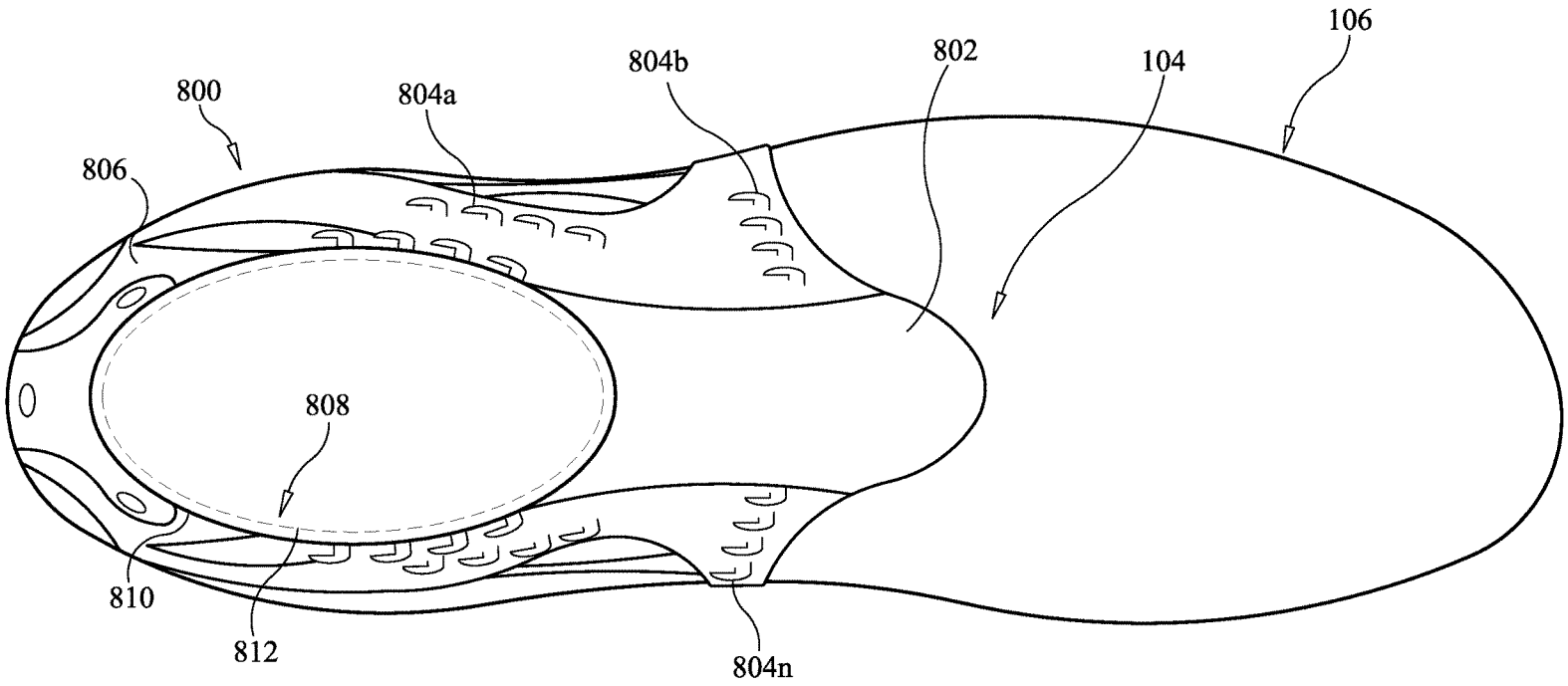
FIG. 8 is a top plan view of a leg support section attached to a shoe and securable to a user's leg in accordance with the present invention.

Referring now to FIG. 8, another embodiment of the bottom portion 800 is depicted in a top plan view. FIG. 8 depicts the center section 802 securable to the top portion 116 (FIG. 1) by a plurality of fasteners 804*a-n*. The fasteners 804*a-n* may be hook-like fastening mechanisms configured to be inserted into an aperture defined by the top portion 116. In other embodiments, the fasteners 804*a-n* may be the same or different from the fasteners 118, 120 described above with respect to the securing device 100. The bottom portion 800 may include a single layer of material or alternatively, may include layers of material that overlap with one another.

In one embodiment, the leg support section 806 may include an inner surface 808 having a padding 810 extending substantially a length 812, e.g., at least 80% of the overall length, of the inner surface 808. The padding 810 beneficially provides comfort to the user's leg when wearing the securing device 100, 600, while simultaneously preventing uncomfortable chafing or friction. In other embodiments, the length 812 of the padding may extend less than 80% of the overall length. The padding may be made of a resilient material different than the material of the securing device 100, 600. In one embodiment, the padding 810 is an elastomeric material such as silicone rubber or neoprene. In other embodiments, the padding 810 is made of a water resilient fabric stuffed with fiber, e.g., cotton.

Figure 9:
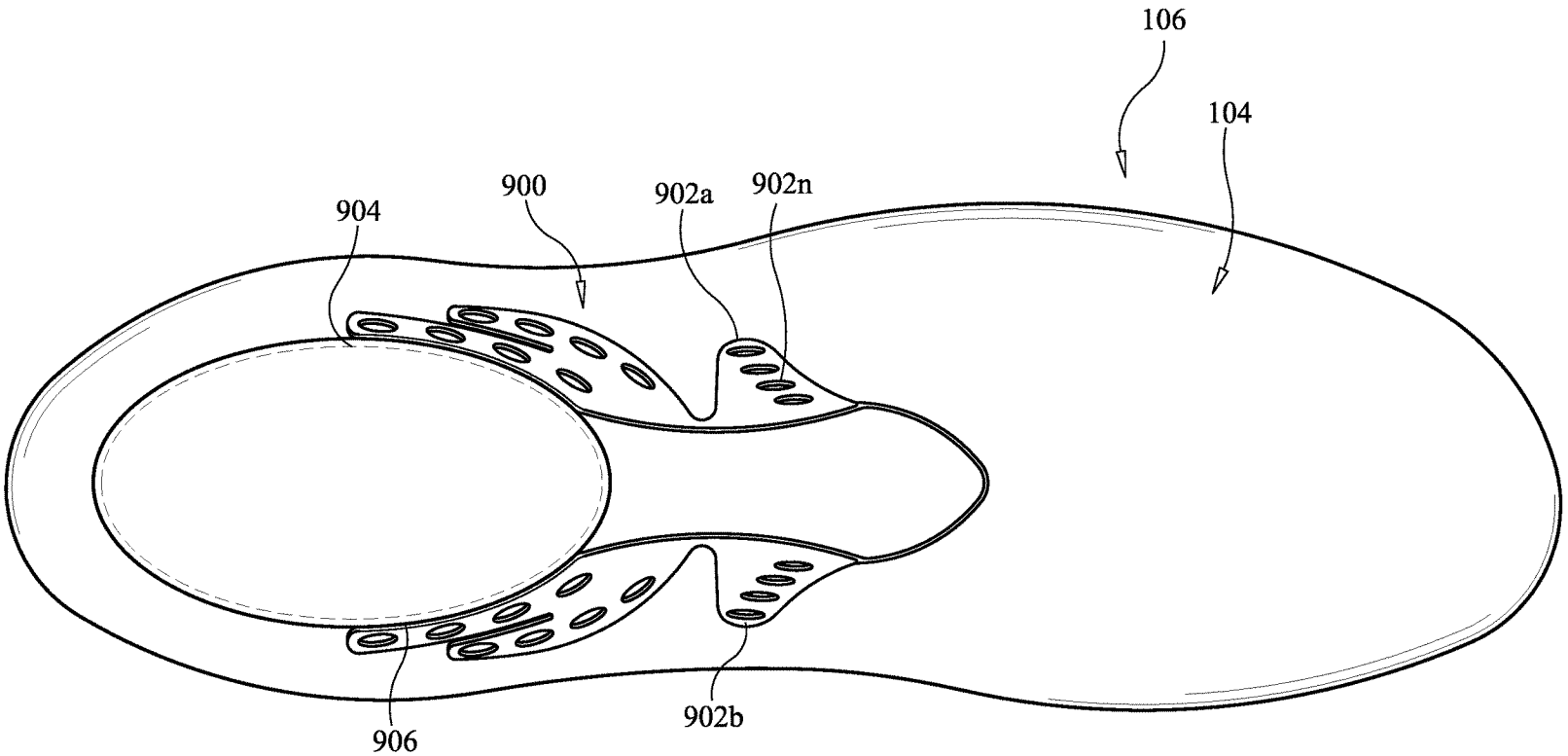
FIG. 9 is a top plan view of a center section of the securing device of FIG. 6 secured to a front region of the shoe.

With reference now to FIG. 9, another embodiment of the top portion 900 is depicted in a top plan view. The top portion 900 is depicted defining a plurality of fasteners 902*a-n*. In one embodiment, the fasteners 902*a-n* are apertures defined by the top portion 900, which are sized and shaped to mate with the fasteners disposed on the bottom portion, which may be, without limitation, the hook-like fastening mechanisms described above with respect to FIG. 8. In other embodiments, the fasteners 902*a-n* may be the same or different from as the fasteners 118, 120 described above with respect to the securing device 100.

In order to stabilize the securing device 100 in a stationary position, the top portion 900 may include a U-shaped channel contouring an upper portion of the shoe 106 and having frictional coating 906. The frictional coating 906 is an anti-slip material that assist in securing the top portion 900 in a stationary position on the outer surface 104 of the shoe 106 to prevent the securing device 100 from sliding. The frictional coating 906 can be any friction-inducing material, e.g., rubber, tape or another similar frictional coating with a coefficient of friction generally high enough to prevent the securing device 100 from sliding horizontally and/or vertically on the shoe 106. In other embodiments, the material of the top portion 900 itself may have a high enough coefficient of friction to prevent the securing device 100 from sliding on the shoe 106.

Figure 10:
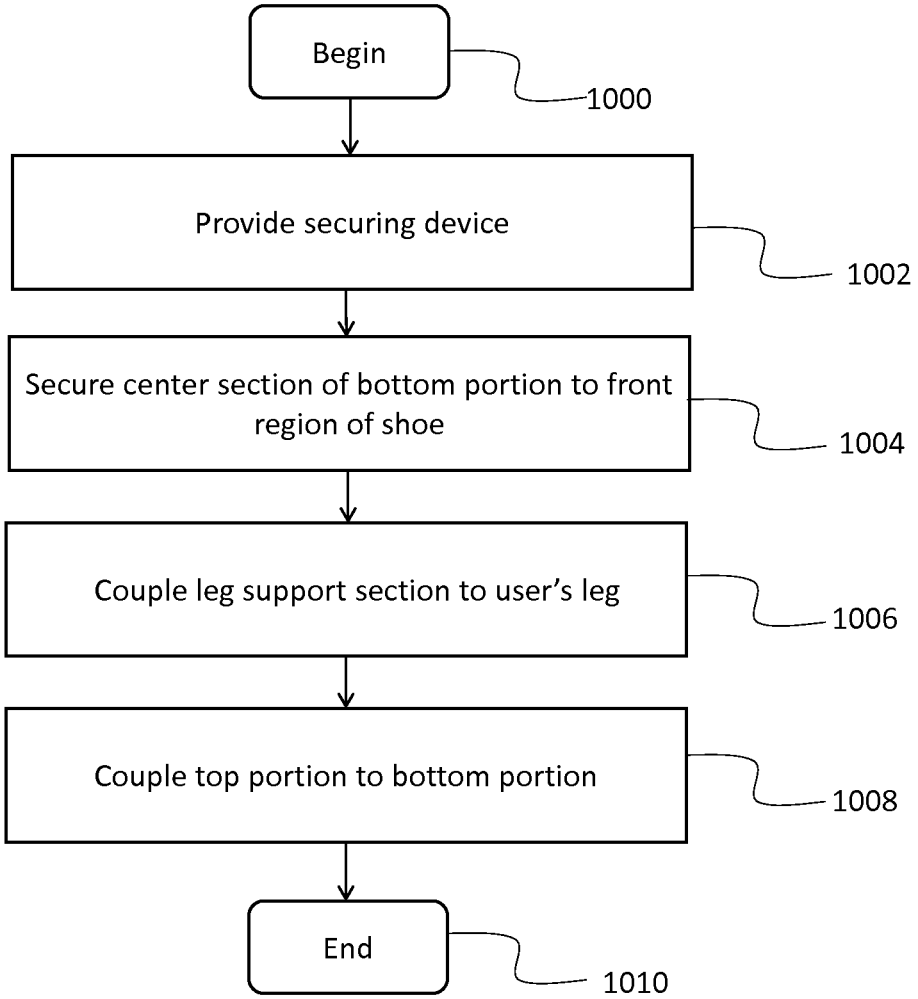
FIG. 10 is a process-flow diagram depicting a method of preventing removal of a shoe in accordance with one embodiment of the present invention.

Referring now to FIG. 10, in conjunction with FIG. 1, there is provided an exemplary process-flow diagram depicting a method of preventing removal of a shoe. The steps delineated in the exemplary process-flow diagram of FIG. 10 are merely exemplary of the preferred order of preventing removal of a shoe using a securing device, and said steps may be carried out in another order, with or without additional steps included therein.

In said process, the method begins as step 1000 and immediately proceeds to the step 1002 of providing, e.g., bringing into physical existence, a securing device, such as the securing device 100 of FIG. 1. The present method however, is not limited to use with the securing device 100 but may also be used with other securing devices, for example and without limitation, the securing device 600.

In one embodiment, the securing device 100 preferably, but not necessarily, includes the web 102 selectively attachable to an outer surface 104 of the shoe 106 and configured to at least partially cover the shoe 106, as similarly described above. The web 102 may include the bottom portion 108 having a center section 110 securable to a front region 112 of the shoe 106 and a leg support section 114 securable to a user's leg. In one embodiment, the web further includes a top portion 116 removably couplable to the bottom portion 108. The top portion 116 may include a coupled position at least partially covering a shoe lace 128 and an uncoupled position leaving the shoe lace 128 exposed to an ambient environment. In other embodiments, the top portion 116 may be fixedly coupled to the bottom portion 108 to form a single unit.

The process proceeds to step 1004 where the center section 110 is secured to the front region 112 of the shoe 106, as discussed above. Either before or after the center section 110 is secured to the front region 112, the process includes step 1006 where the leg support section 114 is coupled to the user's leg. In a preferred embodiment, the leg support section 114 is coupled to the user's leg above the user's ankle so as to prevent rubbing and chaffing against the user's ankle. In other embodiments, the leg support section 114 may be coupled to the user's leg at or below the ankle. Once the center and leg support sections 110, 112 are coupled to the shoe 106 and the user's leg, the user may utilize an adjustment strap, such as the adjustment strap 402 described above in FIG. 4 that provides the user with the ability to pull and adjust the tension and placement of the bottom portion 108.

In step 1008 the top portion 116 is coupled to the bottom portion 108. In one embodiment, as discussed in detail above, in order to removably couple the bottom portion 108 to the top portion 116, the bottom portion 108 may include one or more fasteners 118*a-n* sized and shaped to mate with one or more fasteners 120*a-n* disposed on the top portion 116. The user may then adjust the tension of the web 102 using various approaches and at least one tension adjusting member, as previously described. Advantageously, the securing device 100 provides the user with the ability to adjust the fit to the user's comfort level, while simultaneously ensuring that the shoe 106 is prevented from being removed from the user's foot. As an added advantage, the level of tension may be adjusted from several angles to ensure a secure fit over shoes of various sizes and shapes.

In one embodiment, when the user desires to remove the securing device 100 from the shoe 106, the user may quickly and conveniently remove the web 102 from the outer surface 104 by uncoupling the top portion 116 from the bottom portion 108. In another embodiment, the user may quickly and conveniently remove the web from the outer surface 104 by removing a securing strap, such as the securing strap 122 described above, from either side of the shoe 106. This may be especially convenient for left handed users. The process ends at step 1010.

A securing device and method for preventing removal of a shoe have been disclosed that feature a securing device having a web selectively attachable to an outer surface of a shoe. The securing device may be adjusted from a number of angles to ensure that the securing device securely and comfortably fits the user's shoe, while simultaneously preventing removal of the shoe. As an added advantage, the securing device at least partially covers the shoe, leaving exposure to the ambient environment to prevent heat accumulation within the shoe. Other features of the invention have been disclosed, but are not limited to the particular details disclosed herein.

What is claimed is:

1. A securing device for preventing removal of a shoe comprising:

a web adapted to be selectively attachable to an outer surface of a shoe and configured to at least partially cover the shoe, the web of a flexible material and having:

a bottom portion including a right side portion and a left side portion opposite the right side portion, the right and left side portions each having at least one male fastener;

a center section configured to secure to a front region of the shoe, the center section including a securing strap substantially encircling a bottom portion of the shoe; and a leg support section configured to secure to a user's leg;

a top portion entirely detachable from the bottom portion, the top portion having at least two female fasteners each couplable to the at least one male fastener on the right side portion and the left side portion of the bottom portion, the at least one male fastener of a shape different than and complimentary to a shape of each of the at least two female fasteners;

a coupled position configured to at least partially cover a knot of a shoe lace; and an uncoupled position configured to leave the shoe lace exposed to an ambient environment.

2. The securing device of claim 1, wherein: the web defines a plurality of apertures sized and shaped to expose a substantial portion of the shoe to an ambient environment.

3. The securing device of claim 1, wherein: the at least one female fastener of the top portion is an aperture defined by the top portion, the aperture sized and shaped to receive the at least one male fastener disposed on the bottom portion.

4. The securing device of claim 1, wherein:

the bottom portion is of a color different than a color of the top portion.

5. The securing device of claim 1, wherein: the top portion is operable to decouple the web from the outer surface of the shoe when the shoe lace is exposed to an ambient environment.

6. The securing device of claim 1, wherein; the web includes a heel strap extending from a heel portion of the shoe substantially to the front region of the shoe.

7. The securing device of claim 1, wherein: the leg support section is configured to secure to the user's leg above an ankle of the user.

8. A securing device for preventing removal of a shoe comprising:

a web adapted to be selectively attachable to an outer surface of a shoe and configured to at least partially cover the shoe, the web of a flexible material and having:

a bottom portion including:

a right side portion and a left side portion opposite the right side portion, the right and left side portions each having a first tension adjusting member;

a center section configured to secure to a front region of the shoe; and a leg support section configured to secure to a user's leg;

a top portion entirely detachable from the bottom portion, the top portion including:

at least two second tension adjusting members, the second tension adjusting members couplable to the first tension adjusting members of the bottom portion, the first tension adjusting members of a shape different than and complimentary to a shape of the at least two second tension adjusting members; and a securing strap coupled to at least one of the bottom portion and the top portion, the securing strap extending along a bottom surface of the shoe to substantially encircle the shoe and operable to decouple the web from the outer surface of the shoe.

9. The securing device of claim 8, wherein: the web further comprises a waterproof material.

10. The securing device of claim 8, wherein: the web includes a plurality of tension adjusting members disposed on the bottom portion adapted to couple with a second plurality of tension adjusting members disposed on the top portion.

11. The securing device of claim 8, wherein: the leg support section is configured to secure to the user's leg above an ankle of the user.

12. The securing device of claim 8, wherein:

the web defines a plurality of apertures sized and shaped to expose a substantial portion of the shoe to an ambient environment.

13. A method of preventing removal of a shoe, the method including: providing a securing device for preventing removal of a shoe, the securing device including: a web adapted to be selectively attachable to an outer surface of a shoe and configured to at least partially cover the shoe, the web of a flexible material and having: a bottom portion including a right side portion and a left side portion opposite the right side portion, the right and left side portions each having at least one male fastener; a center section including a securing strap configured to secure to a front region of the shoe; and a leg support section configured to secure to a user's leg; and a top portion entirely detachable from the bottom portion, the top portion having: at least two female fasteners each couplable to the at least one male fastener on the right side portion and the left side portion of the bottom portion, the at least one male fastener of a shape different than and complimentary to a shape of the at least two female fasteners; securing the center section to the front region of the shoe by substantially encircling a bottom surface of the shoe with the securing strap; coupling the leg support section to a user's leg; and coupling the top portion to the bottom portion.

14. The method of claim 13, wherein: the leg support section is configured to secure to a user's leg above an ankle of the user.

15. The method of claim 13, further comprising:

adjusting a tension of the web using at least one female fastener of the at least two female fasteners disposed on the top portion and the at least one male fastener of the bottom portion.

16. The method of claim 13, further comprising: removing the web from the outer surface of the shoe by uncoupling the top portion from the bottom portion.

* * * * *